US011591807B2

(12) United States Patent
De Rick

(10) Patent No.: US 11,591,807 B2
(45) Date of Patent: Feb. 28, 2023

(54) FLOOR PANEL FOR FORMING A FLOOR COVERING

(71) Applicant: FLOORING INDUSTRIES LIMITED, SARL, Bertrange (LU)

(72) Inventor: Jan Eddy De Rick, Geraardsbergen (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 17/391,420

(22) Filed: Aug. 2, 2021

(65) Prior Publication Data

US 2021/0355689 A1 Nov. 18, 2021

Related U.S. Application Data

(63) Continuation of application No. 16/496,230, filed as application No. PCT/IB2018/051898 on Mar. 21, 2018, now Pat. No. 11,136,765.

(60) Provisional application No. 62/474,494, filed on Mar. 21, 2017.

(51) Int. Cl.
*E04F 15/02* (2006.01)
*E04F 15/10* (2006.01)

(52) U.S. Cl.
CPC ..... *E04F 15/02038* (2013.01); *E04F 2201/0138* (2013.01); *E04F 2201/0153* (2013.01)

(58) Field of Classification Search
CPC ... E04F 15/02; E04F 15/02038; E04F 15/045; E04F 15/10; E04F 2201/023; E04F 2201/043; E04F 2201/044; E04F 2201/049; E04F 2201/115; E04F 2201/0138; E04F 2201/0146; E04F 2201/0153; E04F 2201/0176; E04F 2201/0523; E04F 2201/0552; E04F 2201/0588
USPC ..... 52/309.1, 309.13, 582.1, 582.2, 586.1, 52/586.2, 591.1, 592.1, 588.1; 403/339, 403/364
See application file for complete search history.

(56) References Cited

U.S. PATENT DOCUMENTS 3,720,150 A 3/1973 Hurtig
6,505,452 B1 1/2003 Hannig et al.
6,685,391 B1 2/2004 Gideon
(Continued)

FOREIGN PATENT DOCUMENTS

CN 104160101 A 11/2014
CN 104847089 A 8/2015
(Continued)

OTHER PUBLICATIONS

International Search Report from PCT Application No. PCT/IB2018/051898, dated Jun. 15, 2018.

*Primary Examiner* — Brian E Glessner
*Assistant Examiner* — James J Buckle, Jr.
(74) *Attorney, Agent, or Firm* — Workman Nydegger

(57) ABSTRACT

A floor panel arranged to be installed according to the fold-down principle, with a first pair and a second pair of edges. The second pair of edges coupling parts are arranged to be coupled to each other by a downward movement with two contact zones at opposite sides of a male part which fits into a female part. The ratio between the horizontal distance between the middle of the first contact zone and the middle of the second contact zone, and the vertical distance between the middle of the first contact zone and the middle of the
(Continued)

second contact zone is more than 5, and/or wherein well-defined support points are applied.

18 Claims, 6 Drawing Sheets

(56) References Cited

U.S. PATENT DOCUMENTS

| | | | |
|---|---|---|---|
| 7,896,571 | B1 | 3/2011 | Hannig et al. |
| 8,850,769 | B2 | 10/2014 | Pervan |
| 9,175,475 | B2 | 11/2015 | Hannig |
| 9,290,950 | B2 | 3/2016 | Capelle |
| 9,476,207 | B2 | 10/2016 | Capelle et al. |
| 9,528,278 | B2 | 12/2016 | Cappelle |
| 9,556,620 | B2 | 1/2017 | Capelle et al. |
| 9,567,755 | B2 | 2/2017 | Ramachandra |
| 9,670,682 | B2 | 6/2017 | Cappelle |
| 9,670,683 | B2 | 6/2017 | Cappelle |
| 9,771,721 | B2 | 9/2017 | Cappelle |
| 10,214,918 | B2 | 2/2019 | Cappelle |
| RE47,496 | E | 7/2019 | Hannig |
| 10,428,534 | B2 | 10/2019 | Cappelle |
| 10,550,582 | B2 | 2/2020 | Cappelle |
| 10,612,249 | B2 | 4/2020 | Cappelle |
| 2005/0160694 | A1 | 7/2005 | Pervan |
| 2009/0193741 | A1 | 8/2009 | Cappelle |
| 2009/0249733 | A1 | 10/2009 | Moebus |
| 2012/0066996 | A1 | 3/2012 | Konstanczak |
| 2012/0180416 | A1 | 7/2012 | Perra et al. |
| 2012/0266555 | A1 | 10/2012 | Cappelle |
| 2013/0180193 | A1 | 7/2013 | Bossuyt |
| 2013/0276398 | A1 | 10/2013 | Hannig |
| 2013/0283719 | A1 | 10/2013 | Dohring et al. |
| 2013/0309441 | A1 | 11/2013 | Hannig |
| 2014/0283477 | A1 | 9/2014 | Hannig |
| 2014/0366475 | A1 | 12/2014 | Cappelle |
| 2015/0047284 | A1 | 2/2015 | Cappelle et al. |
| 2015/0240500 | A1 | 8/2015 | Stevens, Jr. |
| 2015/0267418 | A1 | 9/2015 | Vermeulen et al. |
| 2015/0337540 | A1 | 11/2015 | Cappelle |
| 2015/0337542 | A1 | 11/2015 | Cappelle et al. |
| 2016/0177578 | A1 | 6/2016 | Ramachandra |
| 2016/0201336 | A1 | 7/2016 | Pervan |
| 2016/0356047 | A1 | 12/2016 | Cappelle |
| 2016/0369516 | A1 | 12/2016 | Cappelle |
| 2017/0037640 | A1 | 2/2017 | Boucke et al. |
| 2017/0101785 | A1 | 4/2017 | Cappelle |
| 2017/0101786 | A1 | 4/2017 | Cappelle |
| 2018/0038115 | A1 | 2/2018 | Cappelle |
| 2019/0017278 | A1 | 1/2019 | De Rick et al. |
| 2019/0177984 | A1 | 6/2019 | Cappelle |
| 2020/0087924 | A1 | 3/2020 | Cappelle |

FOREIGN PATENT DOCUMENTS

| | | | |
|---|---|---|---|
| CN | 104968873 | A | 10/2015 |
| CN | 105715013 | A | 6/2016 |
| DE | 202016102034 | U1 | 5/2016 |
| EP | 1725720 | A1 | 11/2006 |
| EP | 2423410 | A1 | 2/2012 |
| EP | 3121348 | A1 | 1/2017 |
| RU | 2224070 | C2 | 2/2004 |
| RU | 2605476 | C2 | 12/2016 |
| WO | 2005088029 | A1 | 9/2005 |
| WO | 2014033628 | A1 | 3/2014 |
| WO | 2016046800 | A1 | 3/2016 |
| WO | 2017115202 | A1 | 12/2016 |

FLOOR PANEL FOR FORMING A FLOOR COVERING

This application is a continuation of U.S. application Ser. No. 16/496,230, filed Sep. 20, 2019, which is a 371 Nationalization of PCT/IB2018/051898, filed Mar. 21, 2018, which claims the benefit, under 35 U.S.C. 119(e), of U.S. provisional application No. 62/474,494, filed on Mar. 21, 2017.

BACKGROUND OF THE INVENTION

Field of the Invention

This invention relates to a floor panel for forming a floor covering, more particularly for forming a floor covering which can be installed on an underlying surface.

More particularly, the invention relates to floor panels which can be coupled to each other by means of mechanical coupling parts.

SUMMARY OF THE DISCLOSURE

The aim of the invention consists in that a floor covering of such floor panels is easy to install, however, that at the same time still sufficient strength is obtained in the floor covering, more particularly sufficiently strong connections can be realized between the floor panels, such in combination with production techniques which keep the production costs of the floor panels limited.

Primarily, the invention aims at floor panels which can be installed by means of so-called fold-down technique, such in order to be able to fulfill the aimed-at requirement of a simple installation. A fact hereby is that it must be possible to join two of the edges, mostly the short edges in the case of oblong floor panels, into each other by means of a downward movement, wherein then a vertical locking must be achieved. Herein, such vertical locking can be realized with separate elastic locking strips. However, realizing and applying those is costly. In order to exclude this cost, one-piece or substantially one-piece coupling profiles can be applied. However, it is known that such coupling parts realized in one piece mostly offer a not so strong connection; either, the connection is too taut and the floor panels cannot be interconnected or only interconnected by damaging them, or the coupling does not offer enough resistance against unlocking. It seems that the quality of the coupling is extremely dependent on configuration details and applied materials.

In the international patent application PCT/M2016/057706, as well as in the priority documents thereof, amongst which the published DE 20 2016 102 034.4, already combinations of characteristics have been presented with which considerable improvements in floor panels with one-piece coupling parts, and in particular with one-piece vertically active coupling parts, can be achieved, this by applying certain structural features and/or material characteristics and/or designs of the coupling parts. Herein, this relates primarily to the coupling parts which can be joined together by a downward movement, such as necessary when applying the fold-down principle.

The invention aims at a similar coupling as described in PCT/IB2016/057706, however, provides for a number of changes which result in an improved coupling. In general, thereby the coupling is better, however, more specifically it is well usable for being made in one piece in MDF or HDF.

To this aim, the invention provides for a floor panel as defined in the enclosed claims and/or the description following herein below.

More particularly, the present invention relates to a floor panel for forming a floor covering, wherein this floor panel comprises a first pair of opposite edges as well as a second pair of opposite edges;

wherein the first pair of opposite edges comprises coupling parts, which allow that two of such floor panels can be mutually coupled to each other, and wherein these coupling parts show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts are substantially made of the material of the floor panel itself; and the coupling parts are configured such that two of such panels can be coupled to each other at these edges by means of a turning movement;

wherein the second pair of opposite edges also comprises coupling parts at both edges, which allow that two of such floor panels mutually can be coupled to each other, and wherein these coupling parts show the following characteristics:

- the coupling parts comprise a horizontally active locking system, which, in a coupled condition of two of such floor panels, effects a locking in the plane of the floor panels and perpendicular to the respective edges;
- the coupling parts also comprise a vertically active locking system, which, in a coupled condition of two of such floor panels, effects a locking transverse to the plane of the floor panels;
- the coupling parts are substantially made of the material of the floor panel itself; the horizontally active locking system of the second pair of edges is formed at least of an upward-directed lower hook-shaped part, which is situated on one of said two edges, as well as a downward-directed upper hook-shaped part, which is situated on the opposite edge, wherein the lower hook-shaped part consists of a lip with an upward-directed locking element, which, proximally thereof, defines a female part in the form of a recess, whereas the upper hook-shaped part consists of a lip with a downward-directed locking element which forms a male part;
- the coupling parts are configured such that two of such floor panels can be coupled to each other at their respective edges by means of a downward movement of the one floor panel in respect to the other;
- the vertically active locking system of the second pair of edges comprises vertically active locking parts, which, by means of respective contact surfaces define at least a first contact zone and a second contact zone, which are situated at opposite sides of the male part and female part;
- the aforementioned vertically active locking parts comprise a first locking part and a second locking part at the respective opposite sides of the male part, as well as a third locking part and a fourth locking part at the respective opposite sides of the female part;
- in the coupled condition of two of such floor panels, the first and third locking parts define said first contact zone, wherein they have contact surfaces which, in the coupled condition, define at least one inclined tangent line;

in the coupled condition of two of such floor panels, the second and fourth locking parts define said second contact zone, wherein they have contact surfaces, which, in the coupled condition, also define at least one inclined tangent line;

the aforementioned male part has a distal side and a proximal side, wherein the second locking part is situated at the distal side;

the aforementioned two tangent lines are upwardly inclined towards each other as from their respective contact zones, by which is meant that both tangent lines, starting from their respective contact zone, are inclined in upward direction and in respect to the recess of the female part in inward direction, and thus the tangent lines are inclined in upward direction and in respect to a vertical are inclined in opposite directions;

in respect to the plane of the floor panel, the tangent line which is defined by the first and second locking parts is steeper than the tangent line which is defined by the second and fourth locking parts, or, in other words, the angle of the first-mentioned tangent line with the horizontal is larger than the angle of the second-mentioned tangent line with the horizontal;

the difference in size between both mentioned angles is at least 5 degrees and preferably at least 10 degrees;

on the male part, at a height lower than the second contact zone, at least one contact surface is provided, which, in the coupled condition, together with a contact at the female part of the then coupled floor panel, forms a support point which limits the movement of the male part in downward direction;

characterized in that at the second pair of edges further one of the following characteristics or a combination of two, three, four, five, six or all seven of the following characteristics (I)-(VII) is present:

(I) the ratio between, on the one hand, the horizontal distance between the middle of the first contact zone and the middle of the second contact zone and, on the other hand, the vertical distance between the middle of the first contact zone and the middle of the second contact zone, is more than 5 and still better more than 6;

(II) at the male part, at a height lower than the second contact zone, a contact surface is provided, which, in the coupled condition, together with a contact surface at the female part of the then coupled floor panel, forms a support point which limits the movement of the male part in downward direction, wherein this support point is made as a floating support point;

(III) at the male part, at a height lower than the second contact zone, a contact surface is provided, which, in the coupled condition, together with a contact surface at the female part of the then coupled floor panel, forms a support point which limits the movement of the male part in downward direction, wherein this support point is situated at the proximal half or substantially at the proximal half of the male part, whereas at the distal half of the male part no downwardly active support point of only a floating downwardly active support point is present at the lower side of the male part;

(IV) at the lower side of the male part, two support points are present, which in mutual respect are situated at a different height level, wherein the one is situated proximally from the other, and wherein the most proximal support point of these two support points is situated lower than the other of the two support points;

(V) the male part, in the proximity of the proximal half thereof, extends deeper than in the proximity of the distal half thereof;

(VI) the horizontal distance between the middle of the first contact zone and the middle of the second contact zone is at least 3 millimeters;

(VII) underneath the fourth locking part an incision is present reaching proximally into the floor panel, which is cutting the lip of the lower hook-shaped part free, wherein this incision extends inward over a distance, which, measured from the vertical closing plane, shows a horizontal depth which is at least 1/10 and still better at least 1/7 of the horizontal distance between the middle of the first contact zone and the middle of the second contact zone.

The above-mentioned characteristics I to VII each can be applied separately, as well as be combined at choice. As a result, all characteristics as such, as well as all mathematically possible combinations of these characteristics, per definition have to be considered an object of the present invention.

The advantages of the characteristics I to VII will be explained in greater detail below, in the detailed description.

As already explained herein above, the invention is primary suitable for floor panels wherein the coupling parts of the second pair of edges are made in one piece in MDF (Medium Density Fiberboard) or HDF (High Density Fiberboard). The aforementioned characteristics I to VII allow an optimum integration of such coupling parts in MDF or HDF. In practical embodiments, this will relate to floor panels comprising a substrate of MDF or HDF extending over the entire or approximately entire surface thereof, wherein at the edges the aforementioned coupling parts are formed. Herein, the floor panel preferably comprises a decorative top layer. According to a number of practical applications, this top layer consists of DPL (Direct Pressure Laminate), HPL (High Pressure Laminate), wood veneer, a layer of solid wood, linoleum, cork, one or more printing layers, one or more lacquer layers or a synthetic material layer, such as, for example, vinyl, or a combination of two or more of such layers.

The fact that the invention primarily is suitable for being applied in floor panels wherein the coupling parts of at least the second pair of edges are realized in MDF/HDF material, more particularly in the MDF/HDF material of the substrate, does not exclude that it is also advantageous in floor panels of other materials. Another important application of the present invention relates to floor panels which are characterized in that they comprise a, whether or not multi-layered, synthetic material-based substrate, wherein the coupling parts of at least the second pair of edges, and preferably of the first pair of edges, too, are manufactured in one piece of the panel material, and more particularly the material of the substrate, and wherein this floor panel preferably comprises a decorative top layer. More particularly, herein it is preferred that this is a so-called LVT floor panel, either of the "resilient" type or of the "rigid" type; or that it is a comparable floor panel on the basis of another synthetic material than vinyl, for example, polyurethane; or that it is a synthetic material-based floor panel with a substrate that is composed of at least two layers, more particularly with a substrate layer which is realized of foamed and possibly filled synthetic material and which preferably has a thickness which is larger than half of the overall thickness of the floor panel, and a not or less foamed synthetic material layer, which is provided above the substrate layer and has a thickness of at least 1 mm, for example, a vinyl layer, on which then preferably a decorative top layer is present. In such synthetic material-based floor panels one or more reinforcement layers, for example, glass fiber layers, can be present. Also, a variety of fillers and additives may be present in the applied synthetic materials. The fillers may or may not be more than 50 percent by weight of the total weight of the respective material.

According to a possible embodiment of the invention, the floor panel shows the characteristic that the aforementioned lower hook-shaped part, at the distal side of its distal end, is free from mechanical vertically active locking parts. More particularly, herein it is recommended that in the coupled condition a space is present behind the distal end of the lower hook-shaped part. Preferably this means that only in the first and the second contact zone vertically active locking parts are present, thus, on only two locations which are situated opposite to each other. The advantage hereof is that tolerance differences, more particularly production tolerances, can be absorbed more smoothly and thus are less critical in the production of the floor panels.

According to another possible embodiment of the invention, the floor panel shows the characteristic that the aforementioned lower hook-shaped part, at the distal side of its distal end, indeed is provided with one or more mechanical vertically active locking parts, which then cooperate(s) with a locking part, provided for this purpose, of an adjoining floor panel. A disadvantage therein then is that the allowable production tolerances are more critical, however, contrary thereto then there is the advantage that a vertical locking is obtained at three locations, namely in the first contact zone, in the second contact zone and at the distal end of the respective hook-shaped part.

In a preferred embodiment, the floor panel according to the invention is characterized in that the two contact surfaces of the second contact zone, including possible prolongations thereof, seen in cross-section extend both to the left and to the right of the respective closing plane, wherein the closing plane is defined as a vertical plane through the upper edges of the coupled floor panels or at least the location where the floor panels come together at the top.

According a preferred embodiment, the floor panel of the invention is characterized in that at the lower side of the lip of the lower hook-shaped part, a recess extending up to the distal end of the lip is present, said recess allowing a downward bending of the lip, or anyhow of at least a portion thereof, wherein preferably the recess is configured such that the aforementioned downward bending substantially provides for a tilting movement of the upward-directed locking element, wherein thereby, in the portion of the lip situated directly proximal to the upward-directed locking element, no or little downward bending will occur, or at least to a lesser extent then the portion carrying the locking element. More particularly, it is preferred that in the portion of the lip which is situated directly proximal from the upward-directed locking element, then rather a local bending in the form of a hinge movement is taking place, which then results in the downward movement at the location of the upward-directed locking element.

According to another preferred embodiment, the floor panel is characterized in that, at the lower edges of the male part, guiding surfaces, such as chamfers or roundings, are present, which are configured such that the male part, during the downward movement thereof, automatically is guided into the female part, at which the necessary guiding surfaces can be present, too, and that the male part therein always is becoming seated with at least the lower portion in the female part before an apart-pressing force is created as a result of the locking parts, which belong to the second contact zone, initially moving along each other.

Preferably, the tangent line in the first contact zone forms an angle with the horizontal of at least 75 degrees, and still better is at least 80 degrees, and preferably in the order of magnitude of 85 degrees or more.

The tangent line in the second contact zone preferably forms an angle with the horizontal of less than 50 degrees, and still better less than 45 degrees, and still better less than 30 degrees, all of this preferably in combination with the angle values for the tangent line of the first contact zone described in the preceding paragraph.

Preferably, the coupling parts at the second pair of edges are configured such that they, in coupled condition, create a so-called pretension.

In a particularly preferred embodiment, the floor panel of the invention is characterized in that the upward-directed locking element, the downward-directed locking element and the pertaining contact surfaces of the first contact zone are configured such that the upward-directed locking element with its pertaining contact surface, in the coupled condition, adopts a somewhat tilted position in respect to the position which is taken by this contact surface in the free condition; and that both contact surfaces of the first contact zone, in the not coupled condition, mutually are oriented so deviating that, in the coupled condition, mutually a less deviating or not deviating orientation is obtained. Herein, it is preferred that the contact surfaces of the first contact zone, in the coupled condition, coincide with each other or almost coincide with each other. It is also preferred that the aforementioned contact surfaces, when for their free condition the contours thereof are presented on top of each other, converge towards each other or, in other words, provide for a diminishing overlap in downward direction. Still more particularly, herein it preferred that the aforementioned contact surfaces are substantially flat and that, when for their free condition the contours of the coupling parts are presented on top of each other, the respective contact surfaces show an angular difference of 2 to 10 degrees.

According to a preferred embodiment of the floor panel of the invention, the latter is characterized in that it further comprises, if not already mentioned, one or more of the following features, or comprises any combination of these features among each other and/or in combination with any of the features of the previously described characteristics, this as far as such combination does not comprise any contradictory features:

- the coupling parts at the first pair of edges and at the second pair of edges are realized such at the floor panel that the floor panels can be installed according to the fold-down principle;
- the floor panel is oblong rectangular and the first pair of opposite edges forms the long sides of the floor panel, whereas the second pair of opposite edges forms the short sides of the floor panel;
- the coupling parts at the second pair of edges can be joined into each other by means of a downward snap movement;
- the coupling parts at the first and/or second pair of edges are realized substantially as profiled portions in the material of the floor panel, preferably substantially or entirely by means of a machining treatment, preferably by means of one or more milling treatments, for example, with milling cutters which are active under different working angles;

the coupling parts at the first and/or second pair of edges are realized as millable profiled portions, which can be milled with milling cutters with a rotational axis which, during milling, is situated external to the floor panels;

the aforementioned male part is or is not split;

at the second pair of edges only one male part is applied, whether or not split;

the contact surfaces of the second and/or fourth locking part, and preferably of both is, are, respectively, realized flat;

the lower hook-shaped part, and more particularly the lip thereof, is resiliently bendable and/or deformable;

in coupled condition, a space is present behind the distal end of the lower hook-shaped part;

in coupled condition, a space is present above the upward-directed locking element, which space preferably is made continuous with the space mentioned in the preceding paragraph;

the center of the second contact zone is situated higher than the center of the first contact zone;

the second contact zone is a local contact zone, by which is meant that it does not extend over the entire height of the male part; more particularly, this contact zone is situated with its upper end at a distance from the upper side of the floor panel and is situated with its lower end at a distance above the lower end of the male part; more particularly, it is preferred that the second contact zone, seen in the height, is situated between ¼ and ¾ of the overall height of the male part, in other words, the vertical height measured between the lowermost point of the male part and the upper side of the floor panel;

the coupling parts at the first pair of edges and/or at the second pair of edges are made entirely in one piece from the material of the floor panel and more particularly from a substrate forming part of the floor panel;

the distal end of the upper hook-shaped part is entirely free from downwardly active support points above the aforementioned second contact zone;

the coupling parts at the first pair and/or second pair of edges are configured such that in coupled condition a so-called pretension exists, which forces the respective floor panels at the respective edges towards each other, wherein this preferably is realized by applying overlapping contours, and wherein the pretension is the result of a deformation, either an elastic bending or an elastic compression or a combination of both;

the coupling parts at the second pair of edges are free from hook-and-loop fasteners and/or glue connections;

the floor panel is provided with bevels at the first and/or second pair of edges;

the floor panel comprises a top layer and/or decor layer, which extends in one piece from the horizontal top surface of the floor panel to the bevels;

the bevels are formed by impressions;

the floor panel comprises a top layer with a decor;

the floor panels comprise a substrate, which is or is not multi-part and does or does not consist of a plurality of substrate layers, wherein the substrate, or, in the case of a plurality of layers, at least one of the substrate layers consists of a material fulfilling one or more, or any combination, of the following characteristics, as far as such combination does not comprise any contradictions:

synthetic material-based material, foamed or not foamed, "resilient" or hard, whether or not with plasticizer, and whether or not filled with wood-based or bamboo-based material, for example in the form of fibers, chips, dust or sawdust, and/or filled with other substances, for example, chalk, lime, talcum, fillers based on ground stone species; synthetic material-based material, which is foamed with fine pores, such that the majority of the synthetic material-based material does possess pores and/or gas inclusions with dimensions smaller than 1 mm, and better smaller than 0.1 mm and still better smaller than 0.01 mm;

synthetic material-based material, which is obtained by extruding synthetic material-based starting material in the form of plate material, wherein in a preferred embodiment this material is foamed, this in its turn preferably with fine pores which are such that the majority of the synthetic material-based material does possess pores and/or gas inclusions with dimensions smaller than 1 mm, and better smaller than 0.1 mm and still better smaller than 0.01 mm;

synthetic material-based material, which is obtained by strewing synthetic material-based starting material, whether or not combined with other materials, by means of a strewing process and consolidating it under the influence of pressure and possibly increased temperature in the form of plate material, wherein in a preferred embodiment the obtained material is foamed, this in its turn preferably with fine pores, which are such that the majority of the synthetic material-based material does possess pores and/or gas inclusions with dimensions smaller than 1 mm, and better smaller than 0.1 mm and still better smaller than 0.01 mm;

synthetic material consisting of, or on the basis of, or comprising one of the following materials: PP, PE, PET, PUR, PVC, PIR or other suitable synthetic materials;

synthetic material with plasticizers, wherein the synthetic material-based material preferably is chosen from materials mentioned in the preceding paragraphs;

wood-based material, for example, MDF, HDF, prefabricated wood panels, more particularly so-called engineered wood panels, possibly with an adapted core or end strips;

the floor panel is realized as any of the aforementioned kinds:

as a laminate floor panel;

as a so-called "resilient floor panel";

an "LVT" panel or "CVT" panel or a panel comparable to the preceding ones, on the basis of another synthetic material than vinyl;

a floor panel with a first synthetic material-based, preferably foamed, substrate layer, with thereon a preferably thinner second substrate layer made of or on the basis of vinyl or another synthetic material;

as a floor panel with a hard synthetic material-based substrate, more particularly a so-called "rigid" synthetic material panel.

According to a deviating alternative embodiment of the invention, the coupling parts at the first pair of edges are not realized such that two of such floor panels can be coupled to each other at these edges by a turning movement, on the contrary in fact they are configured at least such that they can be coupled to each other by a downward movement. This means that the floor panel can be performed at all four edges by a mutual downward movement between each time two respective floor panels. With this embodiment, it is preferred that at the first pair of edges, too, coupling parts are applied with characteristics as have been defined in the preceding description for the second pair of edges. In the first contact zone then there is no mechanical vertical locking. This in its turn may or may not be combined with a vertically active locking part at the distal end of the lower hook-shaped part, which then can cooperate with a locking part which for this purpose is provided at a floor panel to be coupled.

The present invention also relates to a floor panel which is characterized in that, according to a deviating embodiment, it has a tangent line in the first contact zone, which, instead of the definition given herein above, now forms an angle with the horizontal of 90 degrees, or alternatively even is situated between 90 and 100 degrees.

The invention in general preferably relates to decorative floor panels for a floor covering which is to be installed floatingly.

The invention can also be applied with panels for forming a subfloor.

Alternatively, the invention also relates to a panel as described herein above, with the characteristic that instead of a floor panel it is a wall panel or ceiling panel. All described orientations then have to be interpreted in a respective context. So, for example, in a wall or ceiling panel a downward movement has to be interpreted as a movement "towards the plane of the covering". In a ceiling panel, this thus is upward.

All characteristics which are known from the text, claims and drawings of the international patent application PCT/IB2016/057706 and DE 20 2016 102 034 have to be understood as incorporated in this application, however, with the understanding that this relates to characteristics which are not contradictory to the present claims, or with the understanding that certain characteristics thereof have to be replaced by the presently claimed characteristics. In the description of the present invention, the same parts are indicated with the same reference ciphers as in the patent application PCT/IB2016/057706. According to the present invention, characteristics or partial characteristics described in the patent application PCT/IB2016/057706 can also be applied as subordinate characteristics in combination with the main idea of the present invention.

It is noted that both in the preceding as in the following description, a "floating support point" means that overlapping tolerances are avoided and/or a theoretical space is used in the profile shapes which is very small, preferably is less than 0.2 mm and still better less than 0.1 mm, and preferably a desired value in the order of magnitude of 0.05 mm. The floating support point facilitates joining, however, under load still offers sufficient support without too many height differences.

It is clear that different variants are possible, wherein not necessarily all characteristics I to VII have to be present in combined form.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
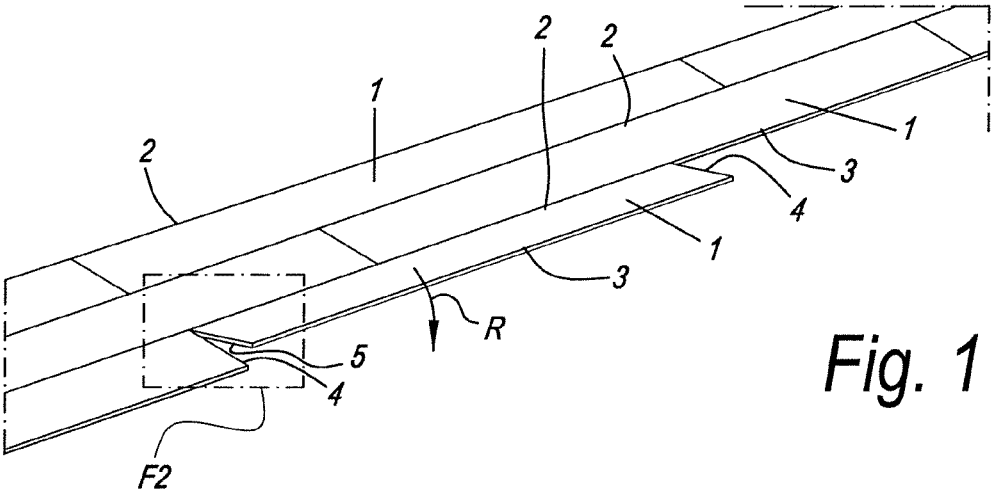
FIG. 1 schematically and in perspective represents a portion of a floor covering consisting of floor panels according to the invention.
Figure 2:
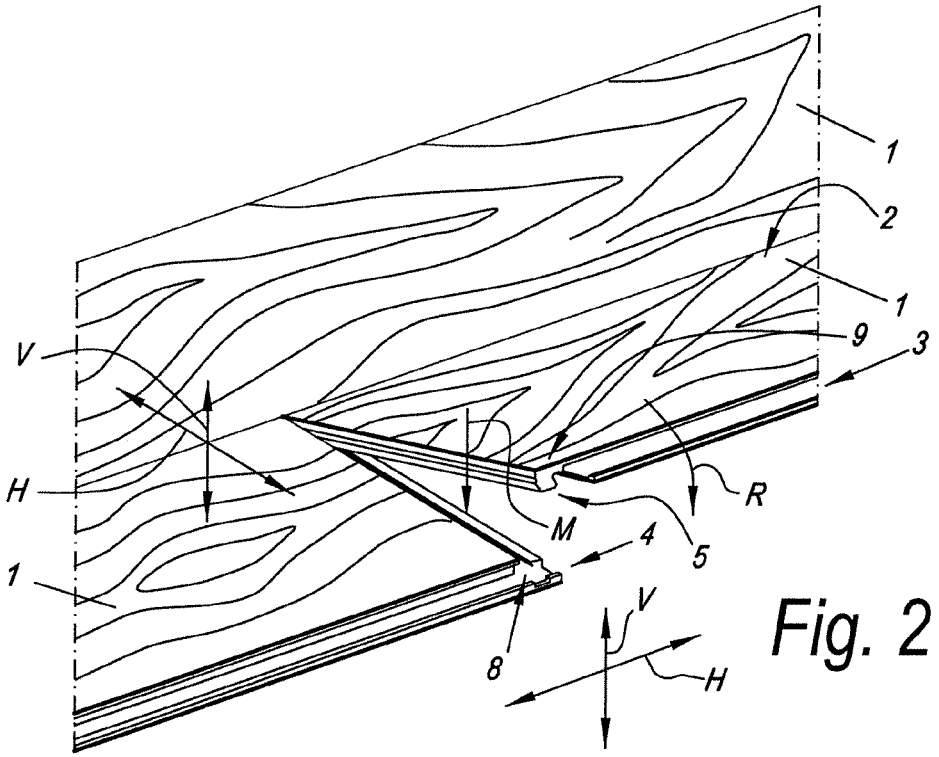
FIG. 2, at a larger scale, represents the portion indicated by F2 in FIG. 1.
Figure 3:
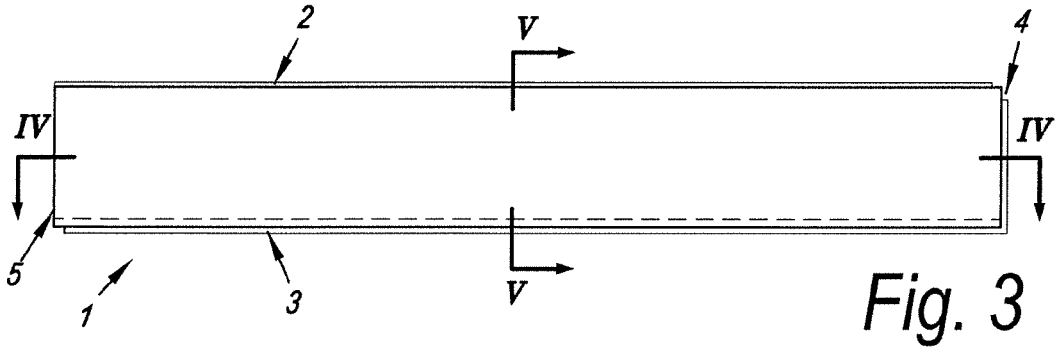
FIG. 3 in top plan view represents a floor panel from the floor covering of FIGS. 1 and 2, FIGS. 4 and 5, at a larger scale, represent cross-sections according to lines IV-IV and V-V, respectively, in FIG. 3.

As represented in FIGS. 1 and 2, the invention relates to floor panels 1 for forming a floor covering, which floor panels 1 comprise a first pair of opposite edges 2-3 and a second pair of opposite edges 4-5.

The represented floor panels 1 are figured such at their edges that they are mutually coupleable according to the so-called fold-down principle, which is a principle known as such and which consists in that such floor panels 1 can be coupled to each other at the first pair of edges 2-3 by a turning movement R and at the second pair of edges 4-5 can be coupled to each other by a downward movement M, wherein the downward movement M is the result of the turning movement R and thus is effected substantially simultaneously. Herein, the floor panels 1 also are configured such at their edges 2-3 and 4-5 that finally a locking is effected in vertical direction V as well as in horizontal direction H, this latter perpendicular to the respective edges.

As represented in FIGS. 3 to 7, such floor panel 1 to this aim at its first pair of edges 2-3 is provided with coupling parts 6-7, whereas at the second pair of edges coupling parts 8-9 are provided, which coupling parts will be described more detailed herein below, with reference to FIGS. 4 to 7.

Figure 5:
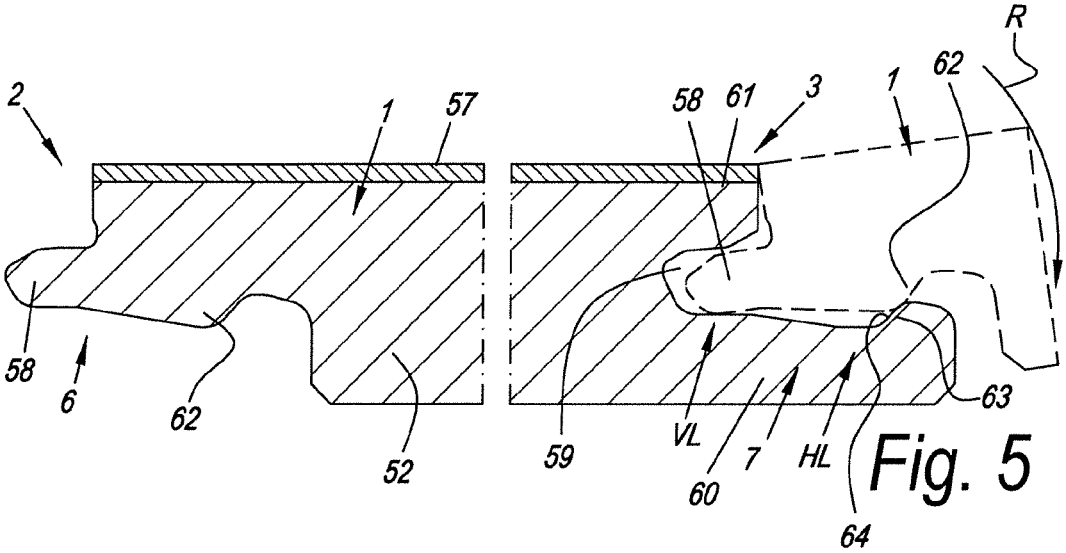

As can be seen in FIG. 5, the coupling parts 6-7 of the first pair of edges 2-3 show at least the following basic characteristics:

- the coupling parts 6-7 comprise a horizontally active locking system HL, which, in a coupled condition of two of such floor panels 1, effects a locking in the plane of the floor panels 1 and perpendicular to the respective edges 2-3;
- the coupling parts 6-7 also comprise a vertically active locking system, which, in a coupled condition of two of such floor panels 1, effects a locking transverse to the plane of the floor panels 1;
- the coupling parts 6-7 are substantially made of the material of the floor panel 1 itself; and the coupling parts 6-7 are configured such that two of such panels 1 can be coupled to each other at these edges by means of a turning movement R.

Figure 4:
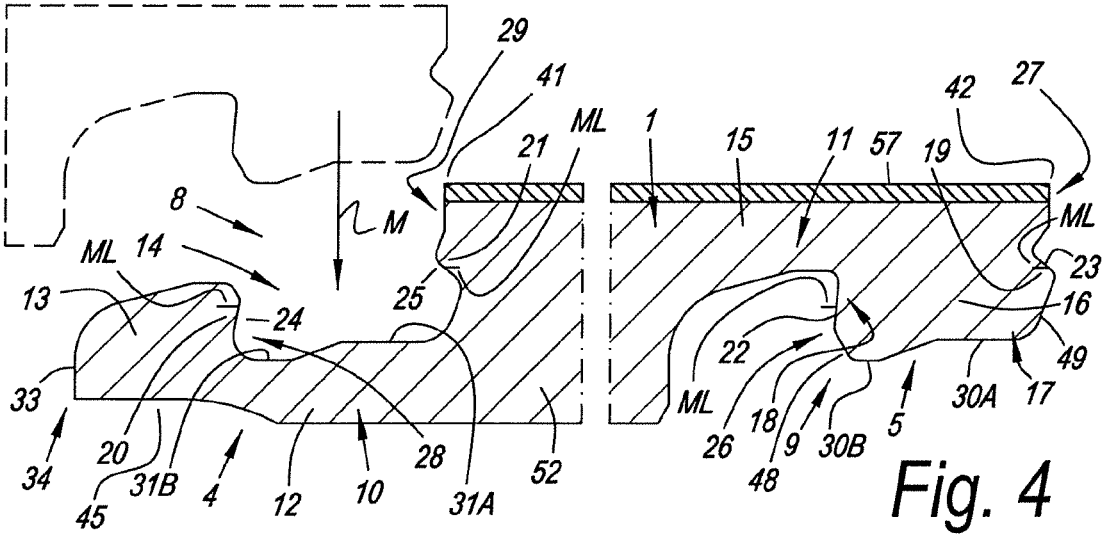
Figure 6:
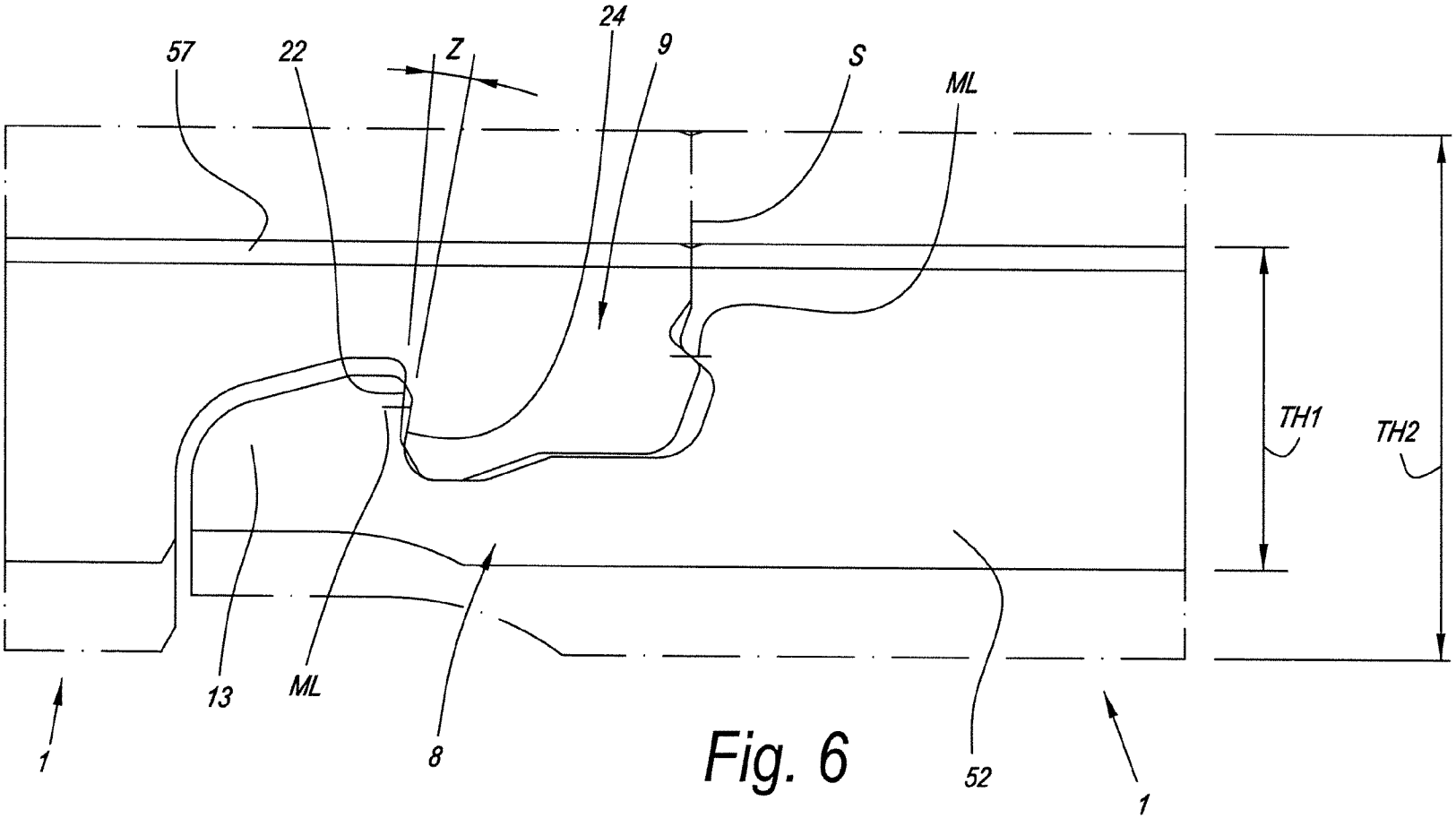
FIG. 6 represents the coupling parts, which are visible in FIG. 4, at a larger scale, wherein the contours of the coupling parts are drawn over each other, in other words are presented against each other in not-coupled condition at the height of the closing plane.
Figure 7:
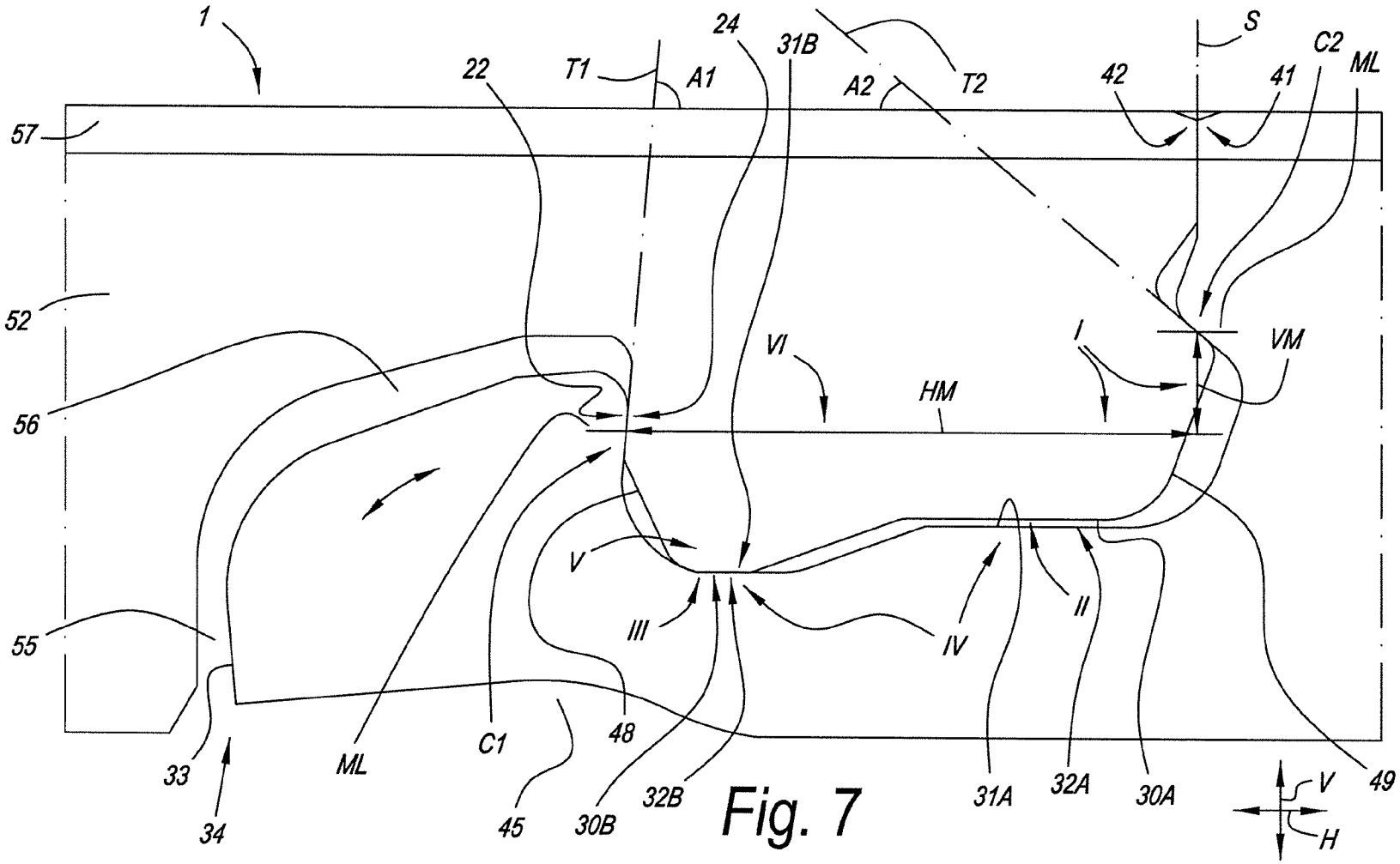
FIG. 7 represents the coupling parts from FIG. 6 in the real coupled condition.

As can be seen in FIGS. 4, 6 and 7, the coupling parts 8-9 of the second pair of opposite edges 4-5 show at least the following basic characteristics:

- the coupling parts 8-9 comprise a horizontally active locking system, which, in a coupled condition of two of such floor panels 1, effects a locking in the plane of the floor panels 1 and perpendicular to the respective edges 4-5;

the coupling parts 8-9 also comprise a vertically active locking system, which, in a coupled condition of two of such floor panels 1, effects a locking transverse to the plane of the floor panels 1;

the coupling parts 8-9 are substantially made of the material of the floor panel 1 itself;

the horizontally active locking system of the second pair of edges 4-5 is formed at least of an upward-directed lower hook-shaped part 10, which is situated on one of said two edges 4, as well as a downward-directed upper hook-shaped part 11, which is situated on the opposite edge 5, wherein the lower hook-shaped part 10 consists of a lip 12 with an upward-directed locking element 13, which, proximally thereof, defines a female part 14 in the form of a recess, whereas the upper hook-shaped part 11 consists of a lip 15 with a downward-directed locking element 16 which forms a male part 17;

the coupling parts 8-9 are configured such that two of such floor panels 1 can be coupled to each other at their respective edges 4-5 by means of a downward movement M of the one floor panel in respect to the other;

the vertically active locking system of the second pair of edges 4-5 comprises vertically active locking parts 18-19-20-21, which, by means of respective contact surfaces 22-23-24-25, define at least a first contact zone C1 and a second contact zone C2, which are situated at opposite sides of the male part 17 and female part 14;

the aforementioned vertically active locking parts comprise a first locking part 18 and a second locking part 19 at the respective opposite sides 26-27 of the male part 17, as well as a third locking part 20 and a fourth locking part 21 at the respective opposite sides 28-29 of the female part 14;

in the coupled condition of two of such floor panels 1, the first and third locking parts 18 and 20 define said first contact zone C1, wherein they have contact surfaces 22 and 24 which, in the coupled condition, define at least one inclined tangent line T1;

in the coupled condition of two of such floor panels 1, the second and fourth locking parts 19 and 21 define said second contact zone C2, wherein they have contact surfaces 23 and 25, which, in the coupled condition, also define at least one inclined tangent line T2; the aforementioned male part 17 has a distal side 27 and a proximal side 26, wherein the second locking part 19 is situated at the distal side 27;

the aforementioned two tangent lines T1-T2 are upwardly inclined towards each other as from their respective contact zones C1-C2, by which is meant that both tangent lines, starting from their respective contact zone, are inclined in upward direction and in respect to the recess of the female part in inward direction, and thus the tangent lines are inclined in upward direction and in respect to a vertical are inclined in opposite directions; in respect to the plane of the floor panel 1, the tangent line T1 which is defined by the first and second locking parts 18 and 20 is steeper than the tangent line T2 which is defined by the second and fourth locking parts 19 and 21, or, in other words, the angle A1 of the first-mentioned tangent line T1 with the horizontal is larger than the angle A2 of the second-mentioned tangent line T2 with the horizontal;

the difference in size between both mentioned angles A1-A2 is at least 5 degrees and preferably at least 10 degrees; and on the male part 17, at a height lower than the second contact zone C2, at least one contact surface 30A and/or 30B is provided, which, in the coupled condition, together with a contact surface 31A and/or 31B at the female part 14 of the then coupled floor panel, forms a support point 32A and/or 32B, which limits the movement of the male part 17 in downward direction.

The particularity of the present invention consists in that at the second pair of edges 4-5 further one of the herein below defined characteristics I to VII is applied or a combination of two, three, four, five, six or all seven of these characteristics is present. The locations of the characteristics I to VI are indicated specifically in FIG. 7 by references I to VI, whereas the location of characteristic VII is indicated specifically in FIG. 9 by reference VII. Herein, this relates to the following characteristics:

(I) the ratio between, on the one hand, the horizontal distance HM between the middle of the first contact zone C1 and the middle of the second contact zone C2 and, on the other hand, the vertical distance VM between the middle of the first contact zone C1 and the middle of the second contact zone C2, is more than 5 and still better more than 6;

(II) at the male part 17, at a height lower than the second contact zone (C2), a contact surface 30A is provided, which, in the coupled condition, together with a contact surface 31A at the female part (14) of the then coupled floor panel, forms a support point 32A which limits the movement of the male part (17) in downward direction, wherein this support point 32A is made as a floating support point;

(III) at the male part, at a height lower than the second contact zone C2, a contact surface 30B is provided, which, in the coupled condition, together with a contact surface 31B at the female part 14 of the then coupled floor panel, forms a support point 32B which limits the movement of the male part 17 in downward direction, wherein this support point is situated at the proximal half or substantially at the proximal half of the male part 17, whereas at the distal half of the male part 17 no downwardly active support point or only a floating downwardly active support point 32A is present at the lower side of the male part 17;

(IV) at the lower side of the male part 17, two support points 32A and 32B are present, which in mutual respect are situated at a different height level, wherein the one is situated proximally from the other, and wherein the most proximal support point 32B of these two support points is situated lower than the other of the two support points;

(V) the male part 17, in the proximity of the proximal half thereof, extends deeper than in the proximity of the distal half thereof;

(VI) the horizontal distance HIM between the middle of the first contact zone (C1) and the middle of the second contact zone C2 is at least 3 millimeters;

(VII) underneath the fourth locking part 21, by which is meant "lower" than this locking part, an incision 14A is present reaching proximally into the floor panel 1, which is cutting the lip 12 of the lower hook-shaped part free, wherein this incision 14A extends inward over a distance, which, measured from the vertical closing plane S, shows a horizontal depth which is at least 1/10 and still better at least 1/7 of the horizontal distance HIM between the middle of the first contact zone C1 and the middle of the second contact zone C2.

These characteristics I to VII will be explained more specifically herein below.

All six characteristics I to VI are applied in the embodiment of FIG. 7. However, this does not exclude that according to not represented variants only one of these characteristics or a limited number of these characteristics can be applied. It is emphasized again that any mathematically possible combination of two or more of the characteristics I to VII is an object of the invention.

According to the first characteristic I, the ratio between the horizontal distance BM and the vertical distance VM between the middles of the contact zones, in other words, the ratio HM/VM, has to meet a requirement. The middles are indicated by marking lines ML. That the ratio HM/VM is greater than 5 and still better is greater than 6 implies that the male part 17 manifests itself relatively longitudinally extended in horizontal direction compared to the global shape of the coupling, that the height difference VM remains relatively small and that the lip 12 of the lower hook-shaped part 10, in relation to the global shape of the coupling, also is relatively long, considering that the length thereof is also determined by the distance HM. The aforementioned ratio provides for that the upward-directed locking part 13 can bend in a relatively smooth manner, even with relatively rigid material, such as MDF or HDF, and the male part 17 can be snapped home in the female part by means of a downward snap movement. At the same time, the relatively small height VM provides for that, with a horizontal traction force, the torque remains small and the coupling therein still offers sufficient resistance against undesired turning open as a result of bending.

It is noted that in principle, by the "middles" of the contact zones each time the middle of the distance has to be understood over which, in cross-section, there is contact between the respective contact surfaces.

According to the second characteristic II, between the male and female parts at least one support point is provided which is active in downward direction, in other words, limits the movement of the male part 17 in downward direction, wherein this support point according to the invention is realized as a floating support point. In FIG. 6, this relates to the support point 32A formed by contact surfaces 30A and 31A. Such floating support point provides for that the male part, at the location of this support point, can be pressed downward with certainty up to the entire depth or even can be pressed somewhat further downward. This has the advantage that the male part 17, amongst others, at the height of the second contact zone C2, can be smoothly brought with its respective locking part 19 up to underneath the respective locking part 21 of the female part 14 by exerting an additional downward force. In other words, hereby the snap effect is facilitated, while still a support point 32A is offered, which, with a large downward load on the floor panel, offers the necessary support at the location of the male part 17.

According to the third characteristic III, at the male part 17 a downwardly active support point 32B is provided, which is situated in the proximal half or substantially in the proximal half of the male part 17, in other words, in FIG. 7 in the left half of the male part 17, while at the distal half of the male part 17, no downwardly active support point or only a floating downwardly active support point 32A is present at the lower side of the male part 17. In that at the distal half, no downwardly active support point or only a floating downwardly active support point 32A is present at the lower side of the male part 17, a particularly rigid support in the distal half is excluded, by which the first-mentioned support point 32B then unhampered can be configured as a support point in an optimum manner. In that the first-mentioned support point is situated in the proximity of the end of the lip 12 of the lower hook-shaped part 10, an elastic support can be provided.

According to the fourth characteristic IV, two support points are present at the lower side of the male part 17, wherein the support point, which is most proximal in respect to the male part 17, is situated lower than the other of the two support points. Herein, one or both of the support points may or may not be realized as floating support points. The fact that the most distal support point at the male part is situated higher, offers the advantage that the lower hook-shaped part can be realized relatively thick in the proximity of its proximal end and a little movable support point, with the exception of a possible floating effect, is offered. The fact that the most proximal support point of the male part is situated lower, implies that the lip of the lower hook-shaped part becomes thinner and thus more flexible towards its distal end, which allows a smooth joining. Also, hereby the possibility is created to work with a larger engagement height between the lower hook-shaped part and the upper hook-shaped part. In the example of FIG. 7, this relates to the support points 32A and 32B, wherein the support point 32B is situated considerably lower than the support point 32A.

It is noted that in FIG. 7 two support points 32A and 32B are present, however, that according to variants, in function of the applied characteristic, embodiments with only one support point are possible, too. The term "support point" means a location where there is contact or can be made. This can be a local point, as well as a zone extending in the cross-section of the respective edge over a distance.

According to the fifth characteristic V, the male part 17, next to the proximal half thereof, extends deeper than next to the distal half thereof, this independently from the fact whether there are support points in downward direction or not. This characteristic implies that the lip 12 of the lower hook-shaped part becomes thinner and thus more flexible towards its distal end, which allows a smooth joining. Hereby, also the possibility is created of working with a larger engagement height between the lower hook-shaped part 10 and the upper hook-shaped part 11.

According to the sixth characteristic VI, the horizontal distance BM between the middle of the first contact zone C1 and the second contact zone C2 is at least 3 mm. This comparatively large distance implies that the lower hook-shaped part 10 is relatively long, too. The inventor has found that such minimal horizontal distance offers good results primarily with coupling parts which are realized from MDF or HDF, more particularly in one piece from an MDF substrate or HDF substrate. It was found that the coupling parts then can be smoothly snapped into each other by a downward movement, while still sufficient vertical locking is obtained. Also, by this length the risk is reduced that the male part breaks off due to sliding off in the MDF or HDF.

Figures 8, 9, 10:
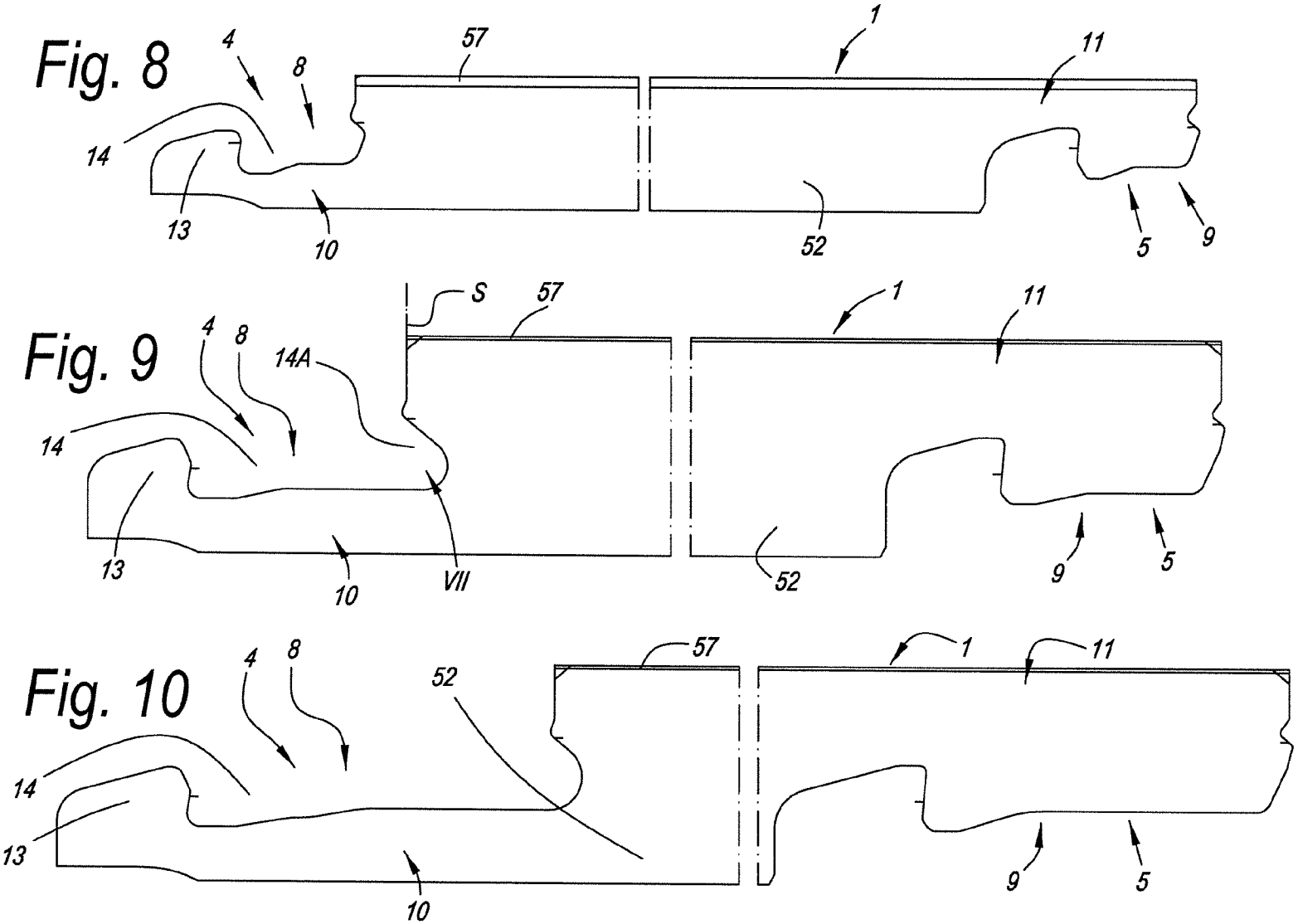
FIGS. 8 to 10 represent some variants, wherein primarily the embodiments of FIGS. 9 and 10 are intended for MDF and HDF.

The incision 14A according to the seventh characteristic VII, an example of which is given in FIG. 9, offers the advantage that the lip of the lower hook-shaped part 10 as such becomes comparatively long and flexible, while the horizontal distance BM between the middles of the contact zones C1 and C2 is less dependent thereon.

In general, the floor panel 1 preferably is composed of a substrate, in the example indicated by reference 52, and at least a decorative top layer 52. Further, at the lower side a not-represented counter layer or balancing layer can be provided, which can have the purpose of preventing the warping of the floor panel.

As represented in the figures, the coupling parts preferably are made in one piece from the panel material, and more particularly from the material of the substrate 52, which preferably is valid for the coupling parts 6-7 of the first pair of edges 2-3 as well as for the coupling parts 8-9 of the second pair of edges 4-5.

It is noted that the substrate 52 as such can be made monolithic, thus, consisting of a single board of a certain material, as well as can be composed of different layers and/or parts.

In the represented embodiment of FIGS. 1 to 5, the substrate 52 consists of a single board, for example, of MDF (Medium Density Fiberboard) or HDF (High Density Fiberboard). The decorative top layer 57 can consist of any material. A number of examples are described in the introduction. In the case of MDF- or HDF-based laminate panels, the top layer preferably consists of DPL (Direct Pressure Laminate), which, as known, mostly consists of a number of resinated paper layers, which are pressed on the substrate and consolidated, amongst which a paper which is provided with a printed decor.

It is noted that such top layer 57 can also consist of a lacquer layer and/or print provided directly on the substrate, which means that the top layer 57 does not necessarily have to consist of a previously produced material layer.

In FIGS. 4-7, the top layer 57 is represented relatively thick. It is clear that this is schematic and that in the case of, for example, DPL or lacquer or the like, this will be a particularly thin top layer.

As can be seen in FIGS. 4, 6 and 7, in the represented example the lower hook-shaped part 10, at the distal side 33 of its distal end 34, is free from mechanical vertically active locking parts. More particularly, in coupled condition a space 55 is present behind the distal end 34 of the lower hook-shaped part 10. As represented, it is also preferred that in the coupled condition a space 56 is present above the upward-directed locking element 13, which space is made continuous with the aforementioned space 55. Hereby is achieved that the locking element 13 is freely movable and cannot be hindered in its working by surrounding material parts.

As explained in the introduction, according to an alternative embodiment indeed a mechanical vertical locking part can be provided at the distal side 33. Both systems, thus, with or without locking part at the distal side 33, each, as explained herein above, have their own advantages.

FIG. 7 also shows the characteristic that the two contact surfaces of the second contact zone C2, including possible prolongations thereof, viewed in cross-section, extend to the left as well as to the right of the respective closing plane S, wherein the closing plane is defined as a vertical plane through the upper edges 41-42 of the coupled floor panels or at least the location where the floor panels come together at the top.

Still another characteristic mentioned earlier, which is applied in the embodiment of FIG. 7, consists in that at the lower side of the lip 12 of the lower hook-shaped part 10 a recess 45 extending up to the distal end of the lip is present, which recess allows a downward bending of the lip, or at least of a portion thereof, wherein preferably the recess is configured such that said downward bending substantially provides for a tilting movement of the upward-directed locking element 13. The tilting movement is clearly visible when comparing FIGS. 6 and 7 to each other.

As represented, it is preferred that at the lower edges of the male part 17 guiding surfaces 48-49, such as chamfers or roundings, are present, which are configured such that the male part, during the downward movement thereof, automatically is led into the female part, on which the necessary guiding surfaces can be present as well, and that the male part therein always comes to sit with at least the lower portion in the female part before an apart-pushing force is created as a result of the locking parts of the second contact zone initially moving along each other.

Preferably, the tangent line T1 in the first contact zone C1 forms an angle A1 with the horizontal of at least 75 degrees and still better at least 80 degrees and preferably in the order of magnitude of 85 degrees or more.

The tangent line T2 in the second contact zone C2 preferably forms an angle A2 with the horizontal of less than 50 degrees and still better less than 45 degrees and still better less than 30 degrees, all this preferably in combination with the angle values for the tangent line of the first contact zone described in the preceding paragraph.

As aforementioned, the coupling parts at the second pair of edges are configured such that they, in coupled condition, create a so-called pretension. In the represented embodiment, this takes place in that the locking part 13, as a result of the tilting movement, wants to bend back elastically, by which the coupled floor panels are tensioned towards each other.

The contours of the coupling parts in FIG. 6, which coupling parts are not coupled in this figure, on the one hand, and the coupled condition of FIG. 7, on the other hand, also illustrate the characteristic according to which the upward-directed locking element 13, the downward-directed locking element 16 and the pertaining contact surfaces of the first contact zone C1 are configured such that the upward-directed locking element 13 with its pertaining contact surface, in the coupled condition, adopts a somewhat tilted position in respect to the position adopted by this contact surface in the free condition; and according to which both contact surfaces of the first contact zone, in the not coupled condition, mutually are oriented such that in the coupled condition mutually a less deviating or not deviating orientation is obtained. As represented in FIG. 7, it is preferred that the contact surfaces of the first contact zone in the coupled condition coincide with each other or approximately coincide with each other.

In FIG. 6 can be seen that the aforementioned contact surfaces, when for their free condition the contours thereof are projected over each other, approach in downward direction or, in other words, provide for a diminishing overlap in downward direction. Herein, the respective contact surfaces show an angular difference Z of preferably 2 to 10 degrees. As an example, the contact surface 22 in FIG. 6 forms an angle with the horizontal of 85.00°, while the contact surface 24 forms an angle with the horizontal of 79.92°.

A number of other subordinate characteristics, which are visualized in the embodiment of, amongst others, FIG. 7, are as follows:

- the center point of the second contact zone C2 is situated higher than the center point of the first contact zone C1;
- the second contact zone C2 is a local contact zone, by which is meant that it does not extend over the entire height of the male part; more particularly, this contact zone is situated with its upper end at a distance from the upper side of the floor panel and is situated with its lower end at a distance above the lower end of the male part; more particularly, it is preferred that the second contact zone, seen in the height, is situated between ¼ and ¾ of the overall height of the male part, in other words, the vertical height measured between the lowermost point of the male part and the upper side of the floor panel;

the distal end of the upper hook-shaped part is entirely free from downwardly active support points above the aforementioned second contact zone C2.

It is noted that the aforementioned vertically active locking system VL and horizontally active locking system HL of the first pair of edges 2-3 can be installed in any manner. Preferably, however, to this aim, as represented in FIG. 5, for the vertically active locking system VL use shall be made of a tongue 58 and a groove 59, which groove preferably is bordered by a lower lip 60 and an upper lip 61. For the horizontally active locking system, use is made of locking parts 62 and 63 provided at the tongue and the groove, which locking parts, in coupled condition, engage one behind the other. Herein, it is preferred that the lower lip 60 distally reaches up to beyond the upper lip 61 and that the locking part 63 also comprises a locking surface 64, which is situated to beyond the distal end of the upper lip 61.

It is noted that coupling parts of one and the same dimension can be applied in various thicknesses of floor panels, this while the characteristics of the invention still remain applicable. This is illustrated in FIG. 6, wherein the floor panel is represented with a thickness TH1, however, alternatively can be realized with another thickness TH2 while maintaining the same coupling profile. By way of example only, the thickness TH1 may be 4 mm and the thickness TH2 6.5 mm.

Figure 11:
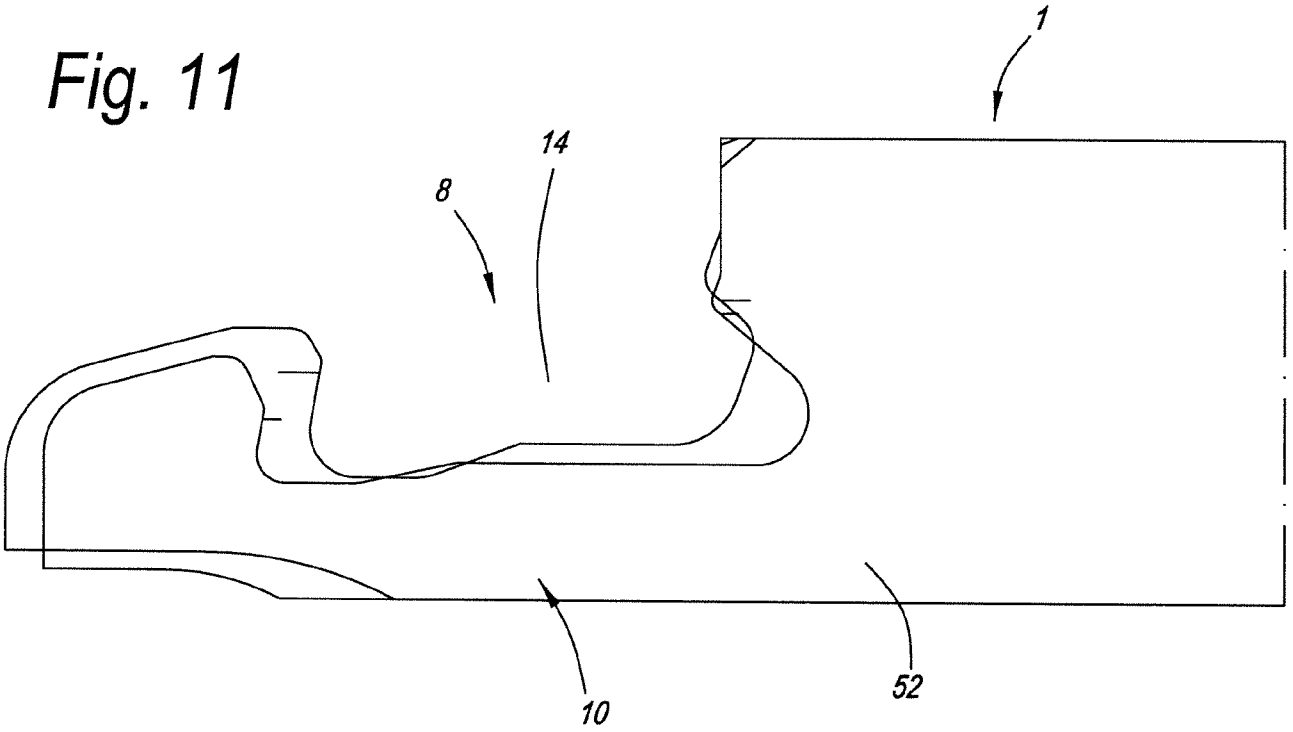
FIG. 11 represents the groove side from FIGS. 8 and 9, however, rescaled to the same thickness and projected on top of each other.

FIGS. 8 to 10 represent, by way of example, three embodiments of the invention with mutually somewhat varied profile forms for the coupling parts. FIG. 11, for the sake of comparison, represents the groove sides of FIGS. 8 and 9, however, rescaled to the same thickness and projected one above the other. In view of the large ratio HM/VM, the embodiments of FIGS. 9 and 10 are particularly suitable for embodiments in MDF or HDF.

The present invention is in no way limited to the embodiments described by way of example and represented in the figures, on the contrary may such panel and in particular floor panel of the invention be realized in various forms and dimensions, without leaving the scope of the invention.

The invention claimed is:

1. A floor panel for forming a floor covering, wherein this floor panel comprises a first pair of opposite edges as well as a second pair of opposite edges;

wherein the first pair of opposite edges comprises coupling parts, which allow that two of such floor panels can be mutually coupled to each other, wherein the coupling parts comprise a horizontally active locking system, which, in a coupled condition of two of such floor panels, effects a locking in a plane of the floor panels and perpendicular to the respective edges;

wherein the coupling parts also comprise a vertically active locking system, which, in a coupled condition of two of such floor panels, effects a locking transverse to the plane of the floor panels;

wherein the coupling parts are substantially made of a material of the floor panel itself;

wherein the coupling parts are configured such that two of such panels can be coupled to each other at these edges by a turning movement;

wherein the second pair of opposite edges comprises coupling parts at both edges, which allow that two of such panels mutually can be coupled to each other, wherein the coupling parts comprise a horizontally active locking system, which, in a coupled condition of two of such panels, effects a locking in the plane of the panels and perpendicular to the respective edges;

wherein the coupling parts also comprise a vertically active locking system, which, in a coupled condition of two of such panels, effects a locking transverse to the plane of the panels;

wherein the coupling parts are substantially made of the material of the panel itself;

wherein the horizontally active locking system of the second pair of edges is formed at least of an upward-directed lower hook-shaped part, which is situated on one edge of said second pair of edges, and a downward-directed upper hook-shaped part, which is situated on the opposite edge, wherein the lower hook-shaped part consists of a lip with an upward-directed locking element, which, proximally thereof, defines a female part in the form of a recess, whereas the upper hook-shaped part consists of a lip with a downward-directed locking element which forms a male part;

wherein the coupling parts are configured such that two of such panels can be coupled to each other at their respective edges by a downward movement of the one panel in respect to the other;

wherein the coupling parts comprise a first locking part and a third locking part, which by respective contact surfaces, define in the coupled condition of two such panels a first contact zone at a first side of the male part and of the female part;

wherein the contact surfaces define at least one inclined tangent line;

wherein the vertically active locking system of the second pair of edges comprises a second, vertically active, locking part and a fourth, vertically active, locking part, which, by contact surfaces define in coupled condition of two such panels a second contact zone, wherein the contact surfaces define at least one inclined tangent line;

wherein the second contact zone is provided at the distal end of the male part and at the proximal end of the female part;

wherein the proximal end of the female part comprises the fourth, vertically active, locking part;

wherein the first contact zone and the second contact zone are situated at opposite sides of the male part and of the female part;

wherein the male part has a distal side and a proximal side, wherein the second locking part is situated at the distal side;

wherein the second pair of second pair of opposite edges each comprise a closing plane, wherein the closing planes of both edges of the second pair of opposite edges are substantially perpendicular to the surface of the floor panel, and wherein the closing planes by contact surfaces define in coupled condition of two such panels a third contact zone provided closer to the panel surface than the second contact zone;

wherein underneath the fourth locking part the floor panel comprises an incision reaching proximally into the floor panel, wherein the incision is cutting the lip of the lower hook-shaped part free, wherein this incision extends inward over a distance, which, measured from the closing plane provided at the edge comprising the fourth locking part, shows a horizontal depth which is at least 1/10 of the horizontal distance between a middle of the first contact zone and the middle of the second contact zone;

wherein the coupling parts of the first pair of opposite edges and the second pair of opposite edges are configurated such that the panel can be installed according to the fold-down principle.

2. The floor panel of claim 1, wherein this incision extends inward over a distance, which, measured from the closing plane provided at the edge comprising the fourth locking part, shows a horizontal depth which is at least 1/7 of the horizontal distance between the middle of the first contact zone and the middle of the second contact zone.

3. The floor panel of claim 1, wherein the tangent line in the first contact zone forms an angle with the surface of the panel in the proximal direction of the coupled panel edge comprising the upward-directed lower hook-shaped part of at least 90 degrees.

4. The floor panel of claim 1, wherein the lower hook-shaped part, at the distal side of its distal end, is provided with one or more mechanical vertically active locking parts, for cooperation with a locking part, provided for this purpose, of an adjoining such panel.

5. The floor panel of claim 1, wherein the closing plane at the edge comprising the downward-directed locking element is provided at the distal end of the downward-directed locking element;

wherein the downward-directed locking element comprises a recess, wherein said recess is provided below the closing plane; and wherein said recess extends at least partially proximal from said closing plane.

6. The floor panel of claim 1, wherein the upper surface of the upward-directed locking element comprises a section which is in uncoupled condition of the floor panel parallel with the surface of the floor panel.

7. The floor panel of claim 1, wherein in respect to the plane of the panel, the tangent line which is defined by the first and third locking parts is steeper than the tangent line which is defined by the second and fourth locking parts, or, the angle of the first-mentioned tangent line with the horizontal, as measured from the first contact zone towards the female part, is larger than the angle of the second-mentioned tangent line with the horizontal, as measured from the second contact zone towards the female part;

wherein the difference in size between both mentioned angles is at least 5 degrees.

8. The floor panel of claim 1, wherein on the male part, at a height lower than the second contact zone, at least one contact surface is provided, which, in the coupled condition, together with a contact surface at the female part of the then coupled panel, forms a support point which limits the movement of the male part in a downward direction.

9. The floor panel of claim 1, wherein the male part comprises a proximal portion at a proximal half thereof extending downwardly more toward a lower side of the panel than a distal portion at a distal half of the male part.

10. The floor panel of claim 1, wherein the aforementioned two tangent lines are upwardly inclined towards each other as from their respective contact zones.

11. The floor panel of claim 1, wherein at the second pair of edges the ratio between the horizontal distance between a middle of the first contact zone and a middle of the second contact zone and the vertical distance between the middle of the first contact zone and the middle of the second contact zone, is more than 5.

12. The floor panel of claim 1, wherein the contact surfaces of the second contact zone, seen in cross-section extend both to the left and to the right of the vertical closing plane, wherein the vertical closing plane is defined as the plane perpendicular to the panel surface and defined by the contact between the closing planes.

13. The floor panel of claim 1, wherein at a lower side of the lip of the lower hook-shaped part, a recess extending up to the distal end of the lip is present, said recess allowing a downward bending of the lip, or anyhow of at least a portion thereof, wherein the recess is configured such that the aforementioned downward bending substantially provides for a tilting movement of the upward-directed locking element.

14. The floor panel of claim 1, wherein, at the lower edges of the male part, guiding surfaces are provided, which are configured such that the male part, during the downward movement thereof, automatically is guided into the female part, at which the guiding surfaces are located, too, and that the male part therein always is becoming seated with at least the lower portion in the female part before an apart-pressing force is created as a result of the locking parts of the second contact zone initially moving along each other.

15. The floor panel of claim 1, wherein the upward-directed locking element, the downward-directed locking element and the pertaining contact surfaces of the first contact zone are configured such that the upward-directed locking element with its pertaining contact surface, in the coupled condition, adopts a somewhat tilted position in respect to the position which is taken by this contact surface in the free condition.

16. The floor panel of claim 15, wherein both contact surfaces of the first contact zone, in the not coupled condition, mutually are oriented so deviating that, in the coupled condition, mutually a less deviating or not deviating orientation is obtained.

17. The floor panel of claim 1, wherein at the lower side of the male part, two support points are provided, which in mutual respect are situated at a different height level relative to a lower side of a lower surface of the floor panel, wherein one support point is situated proximally from another support point of the two support points, and wherein the most proximal support point of the two support points is situated lower relative to the lower surface of the floor panel than the another support point of the two support points.

18. The floor panel of claim 1, wherein the ratio between, on the one hand, the horizontal distance between the middle of the first contact zone and the middle of the second contact zone and, on the other hand, the vertical distance between the middle of the first contact zone and the middle of the second contact zone, is more than 5;

wherein at the male part, at a height lower than the second contact zone, a contact surface is provided, which, in the coupled condition, together with a contact surface at the female part of the then coupled floor panel, forms a support point which limits the movement of the male part in downward direction, wherein this support point is made as a floating support point;

wherein at the male part, at a height lower than the second contact zone, a contact surface is provided, which, in the coupled condition, together with a contact surface at the female part of the then coupled floor panel, forms a support point which limits the movement of the male part in downward direction, wherein this support point is situated at the proximal half or substantially at the proximal half of the male part, whereas at the distal half of the male part no downwardly active support point of only a floating downwardly active support point is present at a lower side of the male part;

wherein the male part, in the proximity of the proximal half thereof, extends deeper than in the proximity of the distal half thereof;

wherein the horizontal distance between the middle of the first contact zone and the middle of the second contact zone is at least 3 millimeters.

* * * * *